United States Patent [19]

Arnoff

[11] 4,168,669

[45] Sep. 25, 1979

[54] ADJUSTABLE HEIGHT TRAY TABLE

[75] Inventor: Philip J. Arnoff, Lyndhurst, Ohio

[73] Assignee: Transco Plastics Corporation, Cleveland, Ohio

[21] Appl. No.: 920,282

[22] Filed: Jun. 29, 1978

[51] Int. Cl.[2] ..... A47B 9/16

[52] U.S. Cl. ..... 108/116; 108/119

[58] Field of Search ..... 108/119, 116, 117, 118, 108/156, 44

[56] References Cited

U.S. PATENT DOCUMENTS

| | | | |
|---|---|---|---|
| 1,608,569 | 11/1926 | Shorey | 108/116 |
| 2,614,348 | 10/1952 | Buser | 108/117 |
| 3,329,104 | 7/1967 | Gittings | 108/117 |
| 3,349,727 | 10/1967 | Hamilton et al. | 108/119 |
| 3,687,092 | 8/1972 | Manning | 108/156 |
| 3,897,738 | 8/1975 | Minsky et al. | 108/119 |
| 4,010,696 | 3/1977 | Priesman | 108/44 |

FOREIGN PATENT DOCUMENTS

| | | | |
|---|---|---|---|
| 707880 | 4/1954 | United Kingdom | 108/116 |

*Primary Examiner*—Francis K. Zugel

*Attorney, Agent, or Firm*—Isler & Ornstein

[57] ABSTRACT

An adjustable height tray table is disclosed having supporting legs which are not permanently secured to the tray, whereby the tray may be removed from the supporting legs and used separately or independently as a serving tray. Adjustment of the height is effected without the use of tools or supplementary fasteners. Indicia are provided on the tray for enabling the user of the tray table to quickly and easily adjust the table to the desired height. Leg assemblies are provided with areas or means which enable the legs to be coordinated with elements of the tray for enabling the desired height to be quickly and easily attained. The tray is provided with locator members which enable the tray to be adjusted to a plurality of selected heights.

3 Claims, 10 Drawing Figures

ADJUSTABLE HEIGHT TRAY TABLE

It has heretofore been proposed, as in Lowry U.S. Pat. No. 2,799,546, to provide an adjustable height foldable table, in which supporting legs are permanently secured to the table or table top.

It has also been proposed, as in Derman U.S. Pat. No. 2,675,286, to provide a collapsible table having a detachable tray top.

The present invention has, as its primary object, the provision of an adjustable height tray table, in which supporting legs are provided which are not permanently secured to the tray table or tray, whereby the tray may be removed from the supporting legs and used separately or independently as a tray.

Another object of the invention is to provide an adjustable height tray table of the character described, wherein adjustment of the tray table height is effected in a simple manner, and without the use of tools or supplementary fasteners.

Another object of the invention is to provide an adjustable height tray table, in which indications or indicia are provided on the tray for enabling the user of the tray table to quickly and easily adjust the table to the desired height.

A further object of the invention is to provide an adjustable height tray table, in which the foldable supporting legs are provided with areas or means which enable the legs to be coordinated with elements of the tray for enabling the desired height adjustment to be quickly and easily attained.

A further object of the invention is to provide an adjustable height tray table, in which the tray is provided with novel means to enable it to be supported at a plurality of selected heights.

A still further object of the invention is to provide a one-piece tray molded of a plastic material and having a cross-sectional contour and reinforcing ribs designed to maintain the tray in a flat condition at all times.

Other objects and advantages of my invention will be apparent during the course of the following description.

In the accompanying drawings forming a part of this specification, and in which like numerals are employed to designate like parts throughout the same, FIG. 1 is a top plan view of an adjustable height tray table embodying the invention;

Figure 1:
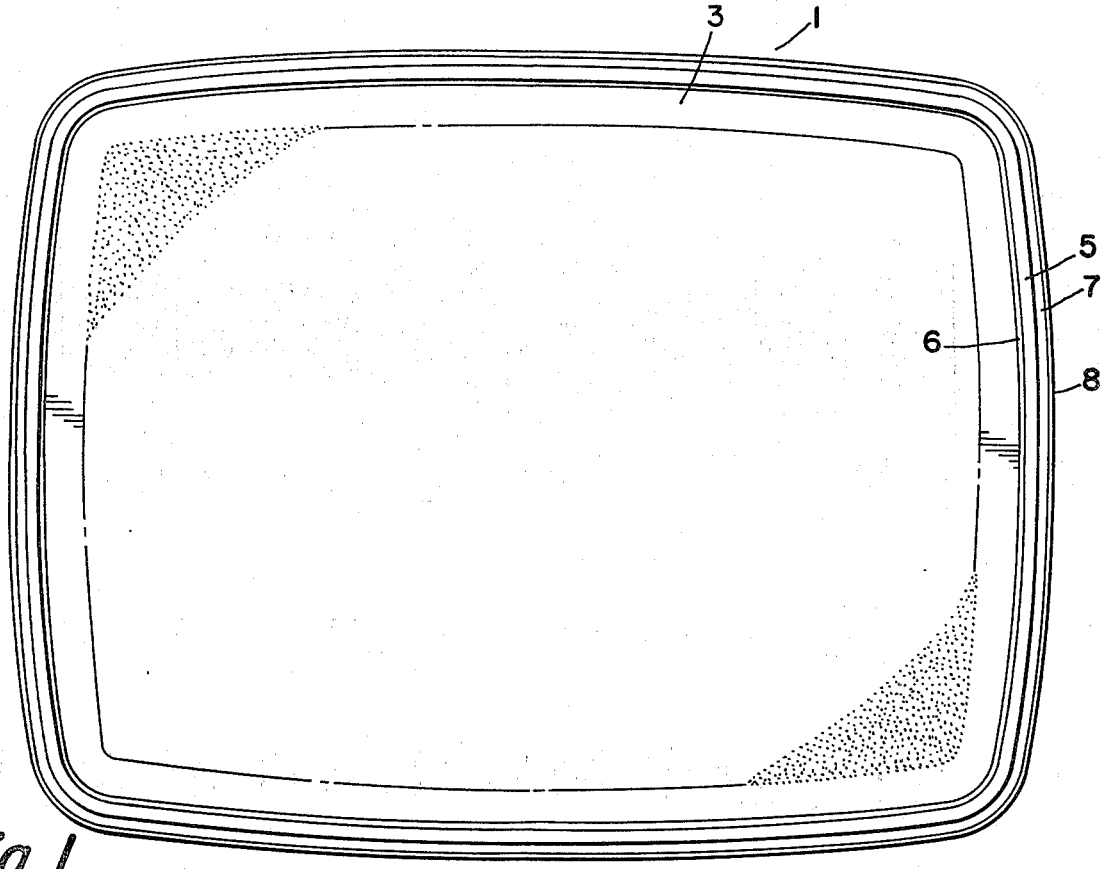

Referring more particularly to the drawings, the tray table will be seen to comprise a tray, designated generally by reference numeral 1, and a leg assembly, designated generally by reference numeral 2.

The tray 1 is molded, in one piece, from a plastic, such, for example, as high impact Styrene, and comprises a flat top 3, of generally rectangular configuration, bounded at its edges by a flange, generally designated by reference numeral 4.

Figure 7:
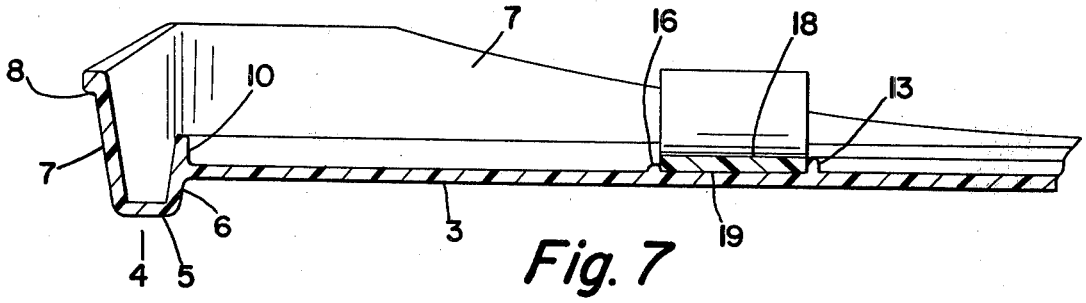
FIG. 7 is a fragmentary cross-sectional view, taken on the line 7—7 of FIG. 2.
Figure 8:
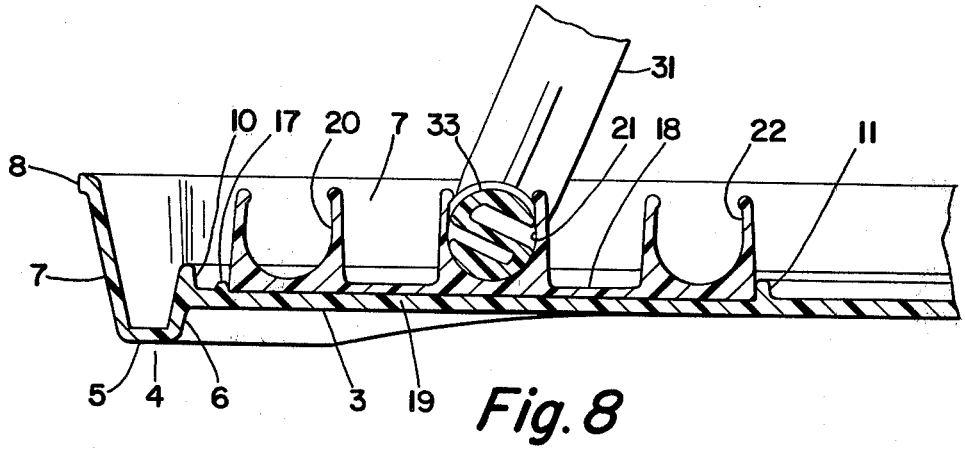
FIG. 8 is a fragmentary cross-sectional view, taken on the line 8—8 of FIG. 2.

As best seen in FIGS. 7 and 8, the flange 4 is of inverted U-shaped cross-section, having a flat or base portion 5, an inner leg 6, which extends from the portion 5 to the top 3, and an outer leg 7, which is of substantially greater length than the leg 6, and which extends outwardly, terminating in a horizontal portion 8.

For the purpose of rigidifying or reinforcing the top 3 of the tray, reinforcing ribs are provided, including a rib 10, which extends downwardly from the top 3 and follows the peripheral contour of said top, longitudinal ribs 11 and 12 which interconnect the ends of the rib 10, transverse ribs 13 and 14, which interconnect the sides of the rib 10 and intersect the ribs 11 and 12, and diagonally-extending rids 15, which extend from said points of intersection to the center of the top 3.

As best seen in FIGS. 2, 5, 7 and 8, areas on the bottom of the tray top 3, delineated by the ribs 11, 12, 13 and 14, and by additional ribs 16 and 17, for the reception of adjustment locators, are designated generally by reference numeral 18.

Each of these adjustment locators 18 is of generally rectangular configuration and is molded, in a single piece, of a plastic, such, for example, as high impact Styrene, to provide a flat base 19, and three depending longitudinally-spaced sockets 20, 21 and 22, which serve a purpose to be presently described.

Figure 2:
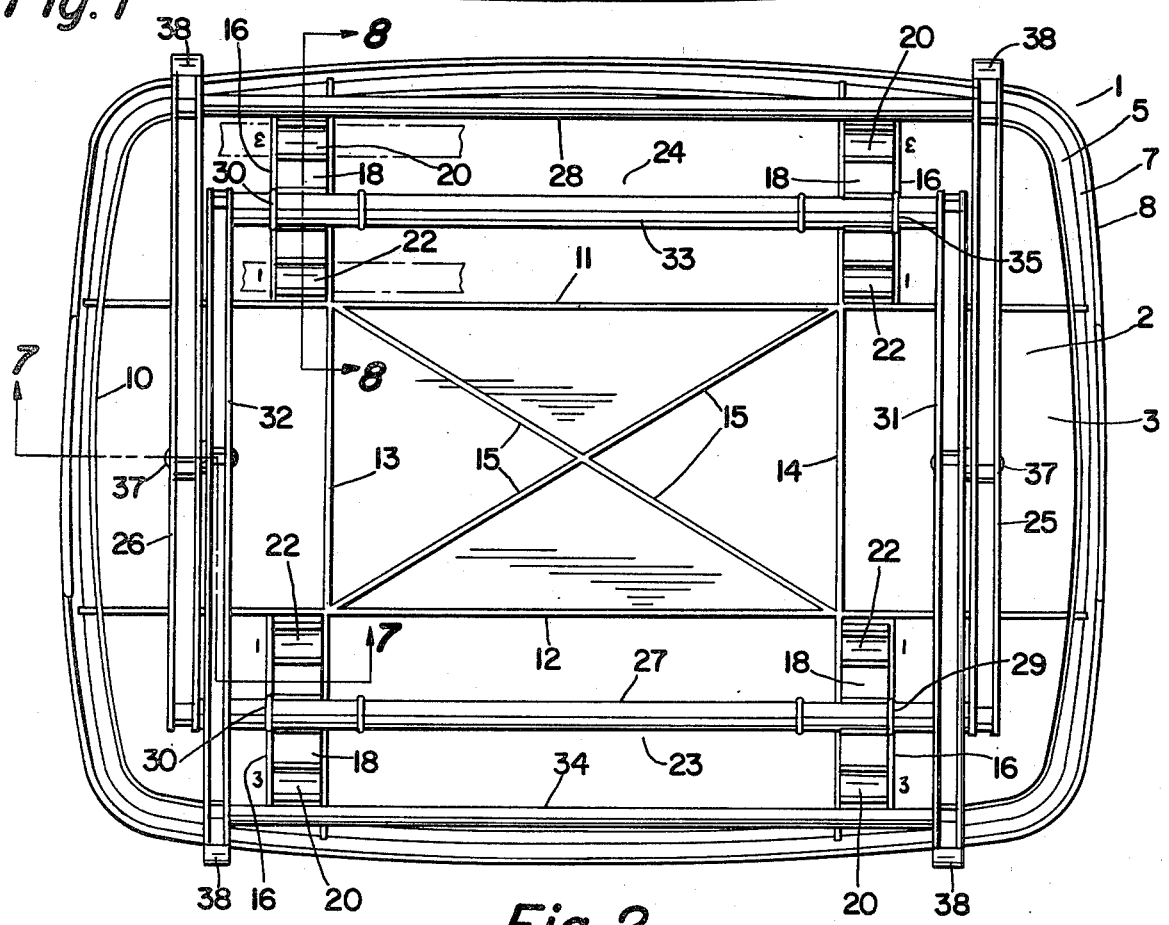
FIG. 2 is a bottom plan view of the tray table.
Figure 3:
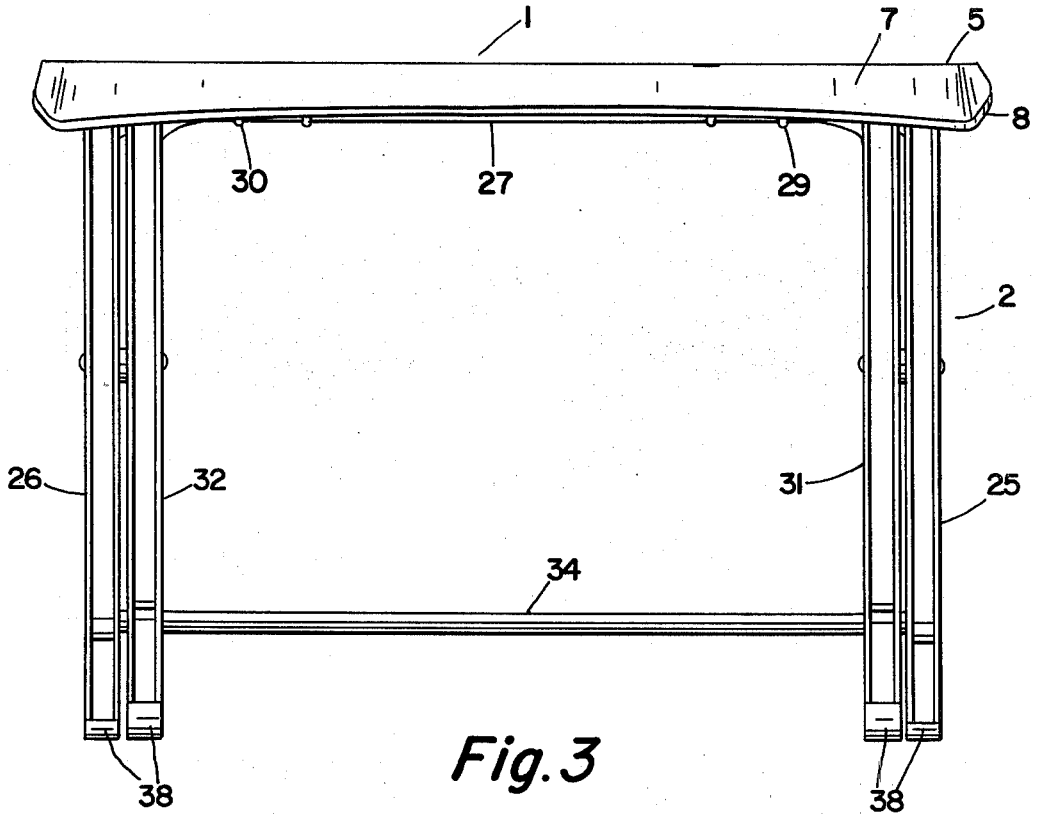
FIG. 3 is a side elevational view of the tray table.
Figure 5:
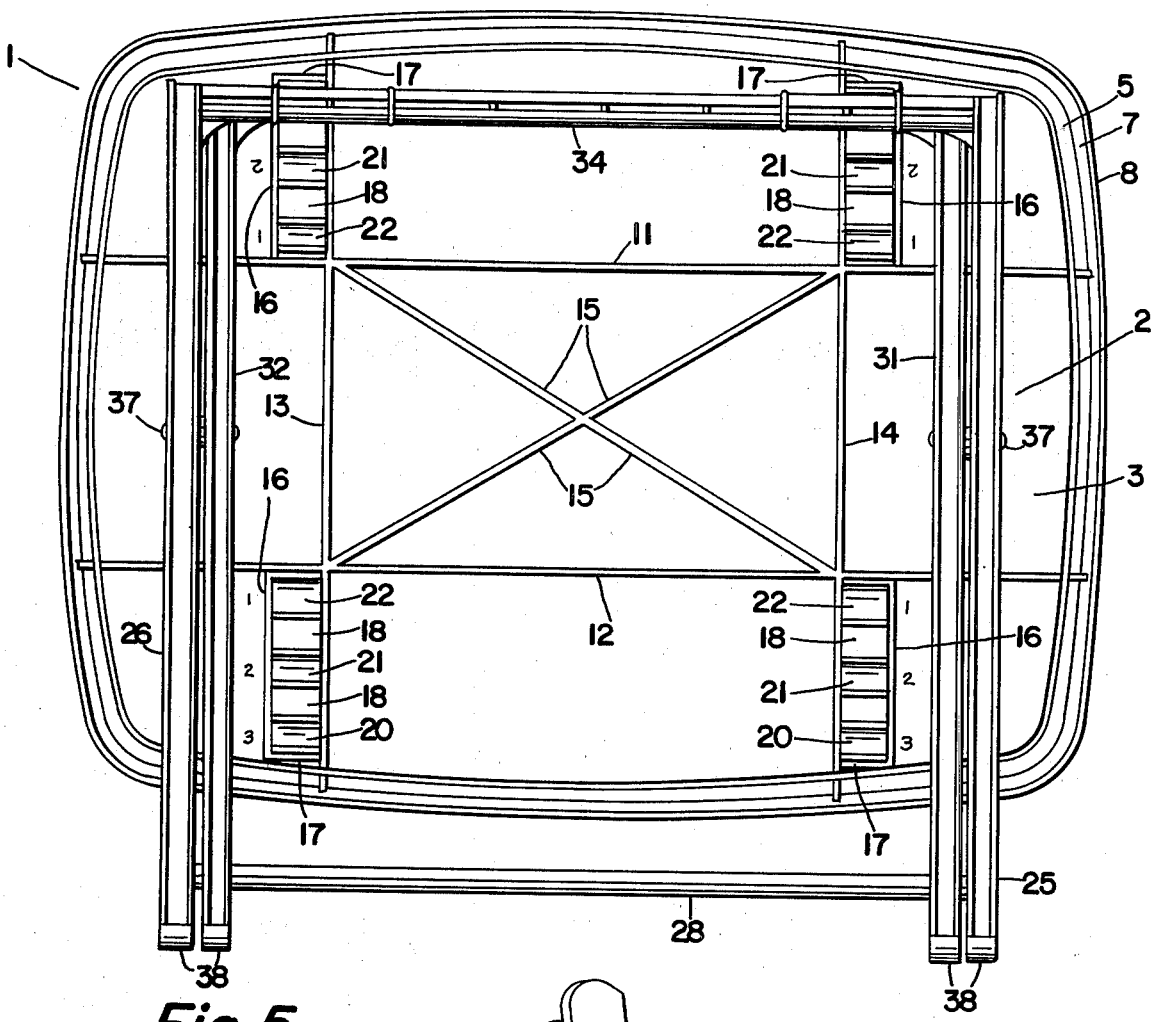
FIG. 5 is a bottom plan view of the tray table, with the legs secured to the tray in a manner facilitating storage of the tray table

These adjustment locators 18 are cemented or otherwise adhesively secured to the bottom of the tray top 3, in the aforesaid delineated areas, with the sockets 22 adjacent the ribs 11 and 12, as best seen in FIGS. 2, 5 and 8.

The sockets 20, 21 and 22 are provided for the purpose of adjusting the height of the tray table, to three different heights, and in order to facilitate such adjustment, the bottom of the tray top is provided with indicia 1, 2 and 3, which are disposed adjacent the sockets 22, 21 and 20 to indicate the desired sockets required for such adjustment.

The leg assembly 2 comprises leg members 23 and 24, each molded, in a single piece, from a plastic, such as high impact Styrene.

The leg member 23 comprises spaced legs 25 and 26, which are interconnected at their upper ends by a round cross-rod 27, and adjacent their lower ends by a brace rod 28.

The cross-rod 27 is provided adjacent its ends with annular projections or beads 29 and 30, which serve a purpose to be presently explained.

The leg member 24 comprises spaced legs 31 and 32 which are interconnected at their upper endsby a round cross-rod 33 and adjacent their lower ends by a brace rod 34.

The cross-rod 33 is provided adjacent its ends with annular projections or beads 35 and 36, which serve a purpose to be presently explained.

Figure 9:
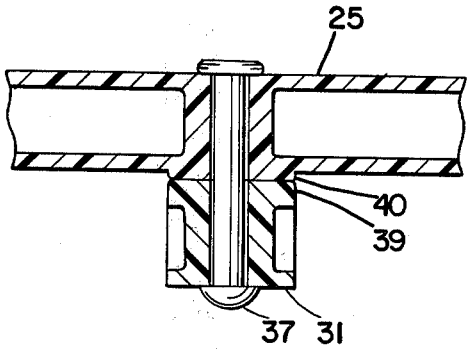
FIG. 9 is a fragmentary cross-sectional view, taken on the line 9—9 of FIG. 4.

The legs 25 and 26 of the leg member 23 are pivotally secured to the legs 31 and 32 of the leg member 24 by means of hollow metal rivets 37 (see FIG. 9).

Figure 10:
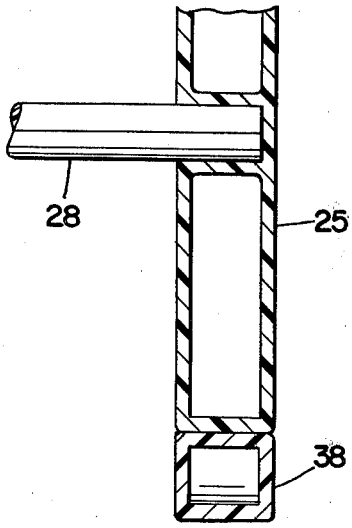
FIG. 10 is a fragmentary cross-sectional view, taken on the line 10—10 of FIG. 4.

The legs 25, 26, 31 and 32 are provided at their lower ends with plastic feet or tips (FIG. 10), which are adhesively secured thereto.

As seen in FIG. 9, the legs 25 and 31 (as well as the legs 26 and 32) are respectively provided with laterally extending bosses or buttons 39 and 40, which lie in abutment with each other and reduce friction between the legs, thereby facilitating pivotal movement of the legs relatively to each other.

The tray table may be adjusted to three different heights, such, for example, as 12", 16-½" or 19".

Figure 4:
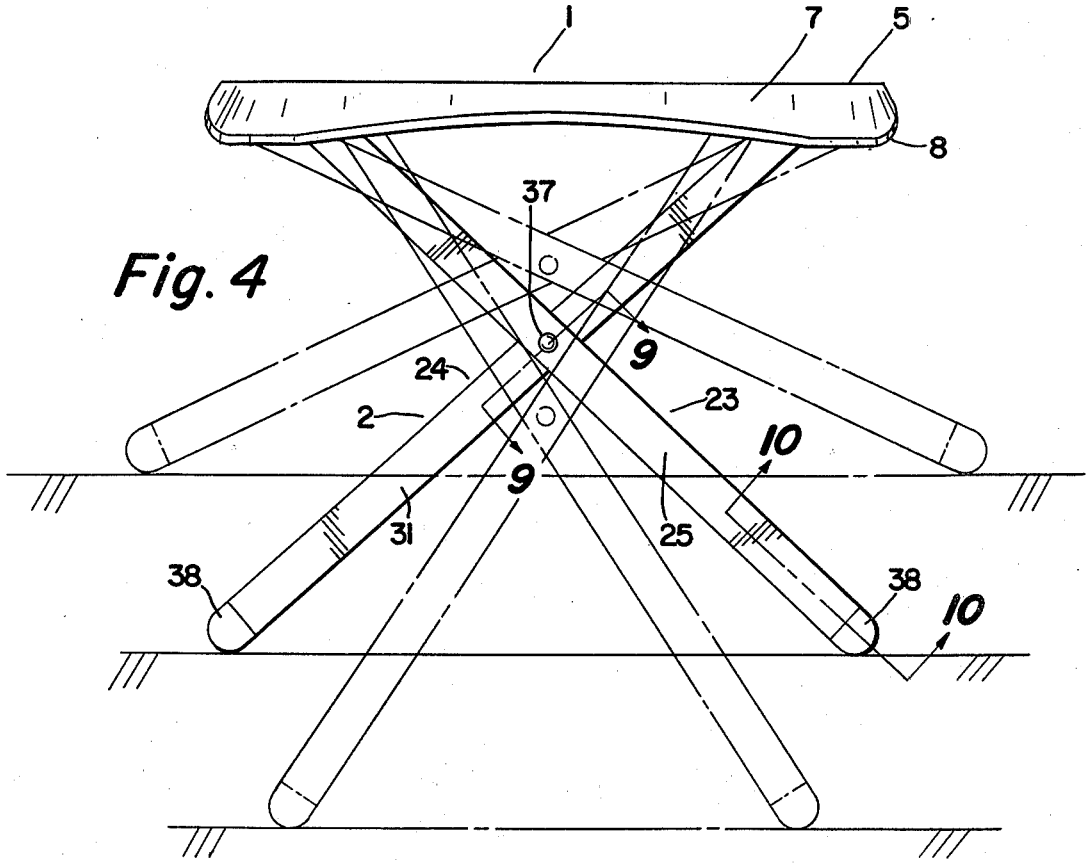
FIG. 4 is an end elevational view of the tray table, as viewed from the right end of FIG. 3.

In FIGS. 2, 3, 8 and 9, and in solid lines in FIG. 4, the table is shown, with the tray at a height of 16-½".

For this purpose, the cross-rods 27 and 33 are snapped into the sockets 21 of the adjustment locators 18, in the manner shown in FIG. 8. To aid in locating the cross-rods properly longitudinally with respect to the locators 18, the annular projections or beads 35 and 36 are brought into abutment with the ends of the sockets 21, as seen in FIG. 2.

In order to elevate the tray to a height of 19", the cross-rods are snapped out of the sockets 21 and snapped into the sockets 22 of the adjustment locators 18, thereby raising the tray to the desired height, as evidenced by the broken line showing of the legs in the lower portion of FIG. 4.

In order to lower the tray to a height of 12", the cross-rods are snapped into the sockets 20 of the adjustment locators 18, thereby lowering the tray to the desired height, as evidenced by the broken line showing of the legs in the upper portion of FIG. 4.

As obvious from the foregoing description, the tray 1, if desired, may be completely removed from the leg assembly, and used separately for serving, or as a bed tray.

Figure 6:
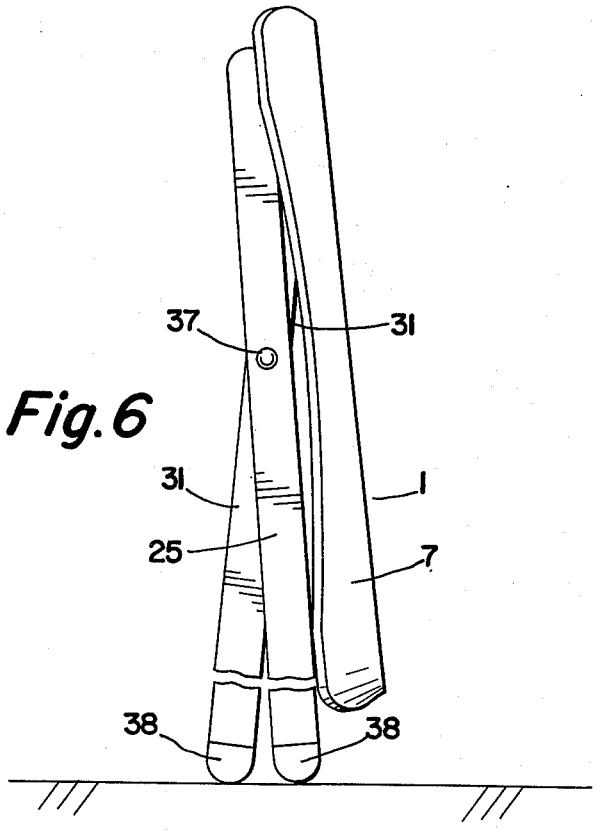
FIG. 6 is an end elevational view of the tray table, as shown in FIG. 5, as viewed from the right side of FIG. 5.

For the purpose of stowing the table in a closet, or storing it in a small space, or standing it against a wall, the tray may be removed from the leg assembly, the legs folded in the manner shown in FIGS. 5 and 6, and the cross-rod 34 snapped into the sockets 20.

In FIG. 1, the area of the tray indicated by the dots may be provided with a rough or satinized finish, for decorative, as well as utilitarian purposes, to prevent sliding of glasses, etc.

It is to be understood that the form of my invention herewith shown and described, is to be taken as a preferred example of the same, and that various changes may be made in the shape, size and arrangement of parts thereof, without departing from the spirit of the invention or the scope of the subjoined claims.

Having thus described my invention, I claim:

1. In an adjustable height tray table, a tray, a pair of foldable leg assemblies having cross-bars, and means adapted to receive said cross-bars for adjusting the height of said tray, said means comprising members secured to the bottom of said tray, each of said members comprising an elongated one-piece plastic molding having a plurality of downwardly facing parallel sockets spaced longitudinally of said member and into which said cross-bars may be snapped, said tray having ribs extending downwardly from the bottom thereof, defining areas in which said members are confined, and said cross-bars being provided with annular projections or beads adapted to abut said members at the ends of said sockets for aiding in properly locating said cross-bars longitudinally relatively to said members, to thereby further facilitate assembly of said leg assemblies with said tray.

2. An adjustable height tray table, as defined in claim 1, wherein said members are cemented or adhesively secured to said tray bottom in said areas.

3. An adjustable height tray table, as defined in claim 2, wherein said tray bottom is provided with indicia adjacent to and associated with said sockets indicative of the height represented by the sockets for facilitating placement of said cross-bars.

* * * * *